US005545882A

United States Patent [19]

Tanaka

[11] Patent Number: 5,545,882

[45] Date of Patent: Aug. 13, 1996

[54] PAPER SHEET COUNTING MACHINE

[75] Inventor: Masaru Tanaka, Kanagawa-ken, Japan

[73] Assignee: Suzuyoshi Corporation, Kanagawa-ken, Japan

[21] Appl. No.: 312,652

[22] Filed: Sep. 27, 1994

[30] Foreign Application Priority Data

Sep. 28, 1993 [JP] Japan ..... 5-265903

[51] Int. Cl.[6] ..... B61L 1/16; G06M 7/00; B65H 3/52

[52] U.S. Cl. ..... 235/98 R; 271/121

[58] Field of Search ..... 235/98 R, 98 A, 235/98 B, 98 C; 271/119, 121

[56] References Cited

U.S. PATENT DOCUMENTS 4,113,244 9/1978 Ruenzi ..... 271/171

*Primary Examiner*—Cassandra C. Spyrou

[57] ABSTRACT

A paper sheet counting machine is disclosed, wherein sheet catching rollers are rotated to feed out paper sheets one after another by means of a friction. A sheet separating roller and a sheet separating plate cooperate to transport the fed out paper sheets, the former having a friction coefficient in connection with the paper sheets which is larger than a friction coefficient existing between the paper sheets themselves and the latter having a same nature of friction coefficient with the sheet separating roller so that the roller is rotated to transmit a transportation power to each of the paper sheets while the plate gives a braking power to each of the paper sheets thereby to prevent more than two paper sheets are transported in an overlapped condition. A counter is operated to count the paper sheets as these are transported past the counter while an angle sensor is operated to detect the rotation angles of the roller to check the width of the paper sheets thereby to discriminate if more than two paper sheets are transported in an overlapped condition, and if so, a warning signal is produced.

9 Claims, 11 Drawing Sheets

PAPER SHEET COUNTING MACHINE

FIELD OF THE INVENTION

The invention relates to a paper sheet counting machine and more particularly relates to a machine for counting paper sheets, which is mechanically simple and compact and further reliable in operation and may be produced at a lower cost, wherein the paper sheets are transported one after another at a high speed by means of frictions produced between a sheet separating roller, a sheet separating plate and the paper sheets to be transported while the paper sheets are definitely separated one from another. The transported paper sheets are correctly counted up one by one and the counts are displayed. Further the transported paper sheets will not cause winds to be blown against the machine user, the winds generally containing minute dusts attached to the paper sheets. In this respect, the paper sheet counting machine is hygienic to the human body.

BACKGROUND OF THE INVENTION

The conventional paper sheet counting machine such as a paper money counting machine is so structured as to feed many sheets of paper money by means of a mechanism including a catching roller which transfers the sheets of paper money one after another to a feeding roller for feeding the sheets of paper money while the sheets are counted. However according to the conventional machine, the new sheets of paper money are often attached to each other and two or more sheets of paper money are transported at a same time as overlapped, namely an erroneous transportation will often happen and this results in miscounting of money.

For the purpose of preventing such erroneous transportation, it has been proposed and actually reduced into practice that a separating roller is provided next to the feeding roller in such a manner that the separating roller is rotated at a circumferential rotation speed of 2 times as fast as the rotation speed of the feeding roller or two separating rollers are provided coaxially with the feeding roller on both sides thereof in such a manner that the separating rollers have an approximately same diameter with the feeding roller but are rotated at a circumferential rotation speed of 1.3–2.0 times as fast as the rotation speed of the feeding roller. Such difference between the circumferential rotation speeds of the rollers have been utilized to separate the sheets of paper money one from another.

It is generally admitted that the paper money counting machine is useless unless the machine is operated to cause extremely little occurrence of erroneous transportation of the sheets of paper money. For example, if the probability of erroneous transportation is 1/5000, the machine is useless. The standard is very strict and the machine is usable only when the erroneous transportation probability is 1/50000. Therefore it has been required to employ such conventional paper money counting machine of complicated mechanism.

Actually the conventional paper money counting machine has a sheet separating mechanism including a sheet separating roller provided next to the feeding roller. Therefore a specific mechanism is required to rotate the separating roller at a high speed. Such a mechanism is required to have many constituent parts and accordingly the machine becomes structurally complicated and big sized and detracts from durability. Further the production cost is very high.

The conventional paper money counting machine is provided with a wheel having many wings. The winged wheel is arranged next to the sheet separating mechanism and is rotated to securely mount the sheets of paper money one after another onto a stacker without the interferences of the paper money sheets to be caused therebetween. The winged wheel is rotated to turn the sheets of paper money by 90 degrees when the sheets of paper money are transported one after another in a horizontal direction to the winged wheel. Thus the winged wheel is operated to transport the sheets of paper money to the stacker in a condition that the sheets of paper money are elected in the stacker. Thus the conventional machine is required to have the winged wheel and an additional mechanism to drive the winged wheel. The machine is therefore destined to become big sized.

Further when the sheets of paper money are turned at a high speed by 90 degrees, a wind is produced and is blown against the machine user sitting in front of the machine. Such a wind contains the dusts generated from the sheets of paper money and is hygienically undesirable and further gives uncomfortable feelings to the machine user.

SUMMARY OF THE INVENTION

The present invention has been provided to eliminate the defects and disadvantages of the prior art. It is therefore an object of the invention to provide paper sheet counting machine which is mechanically simple and compact and is unique in operation without producing a wind to be blown against the machine user.

It is another object of the invention to provide a paper sheet counting machine which is incorporated with a sheet separating roller and a sheet separating plate for cooperation with each other to transport paper sheets, the former having a frictional elastic element attached thereto which has a friction coefficient ($\mu_1$) and the latter having a frictional element attached thereto which has a friction coefficient ($\mu_2$, $\mu_2>\mu_1$) so that the former will transmit a transportation power to the paper sheets while the latter will give a braking power to the paper sheets, thereby to transport the paper sheets separately one from another.

It is another object of the invention to provide an adjusting device manually operated to adjust a clearance between the sheet separating roller and the sheet separating plate in accordance with the thickness of the paper sheets to be counted, thereby to enable the machine to count up any types of paper sheets from the paper money sheets to the identification cards.

It is another object of the invention to provide a counter in connection with the sheet separating roller and the sheet separating plate so that the counter will securely count up the paper sheets as the paper sheets are transported one after another separately by the sheet separating roller and the sheet separating plate.

It is another object of the invention to provide a sheet beating device which is normally spring biased in the vertical direction to render each of the paper sheets into a form of wave vertically of the paper sheet transporting direction as these are transported out of the sheet separating roller so as to give a stiffness to each of the paper sheets as these are transported out of the sheet separating roller thereby to enable the sheet separating roller to positively transport the paper sheets due to the stiffness thereof. At the same time, the stiffness of the paper sheets is utilized to swing up the beating device against the action of the spring so that the beater device will swing down to beat the upper side of each of the paper sheets thereby to instantly press down each paper sheet when it is completely transported out of the sheet separating roller, thereby to eliminate the probability of interferences to be otherwise occurred between the paper sheets and thereby to enable the machine to positively and correctly accumulate the counted paper sheets in a stacker.

It is another object of the invention to provide an angle sensor in connection with the counter for detecting the intermitting rotation angles of the sheet separating roller to continuously produce intermitting pule signals while the counter is producing a counting signal detecting each of the paper sheets which is being transported, thereby to check if the number of the intermitting pulse signals is in accord with a number of pulses predetermined in dependence with the width of the paper sheets to be counted, thus to check if more than two paper sheets are transported at the same time as are partly overlapped.

It is another object of the invention to provide a resin sheet or resin film of nylon, polyacetal, fluorine or polyethirene attached to the outer circumference of the sheet separating roller except the part thereof where the frictional elastic element is attached in such a manner that the diameter of the sheet separating roller involving the resin sheet or the resin film is Slightly smaller than the diameter thereof involving the frictional elastic element, so that only the frictional elastic element will cooperate with the frictional element on the sheet separating plate to transport each of the paper sheets in a condition that the paper sheets will be transported separately one from another sice the resin sheet or resin film has a friction coefficient in connection with the paper sheets which is smaller than the friction coefficient existing between the frictional elastic element and the paper sheets.

It is still another object of the invention to provide a paper sheet counting machine which is reduced into approximately one half in size of the conventional paper sheet counting machine by providing a simple and compact mechanism in which the paper sheets fed out to be counted are turned by 180 degrees on the way of transportation into the stacker where the counted paper sheets are accumulated, thereby further to provide a smaller and light weighted paper sheet counting machine which is further produced at a lower cost approximately one half of the production cost of the conventional machine.

In short, the paper sheet counting machine of the invention substantially comprises: drive means; sheet separating roller means rotated by the drive means to wind the paper sheets therearound to transport the same one after another, the sheet separating roller means having a frictional elastic element attached partly to the outer circumference thereof and the frictional elastic element having a friction coefficient in connection with the paper sheets which is larger than a friction coefficient existing between the paper sheets themselves; and sheet separating plate means having a frictional element attached thereto at a position facing the sheet separating roller means and the frictional element having a friction coefficient in connection with the paper sheets which is larger than the friction coefficient existing between the paper sheets themselves; whereby the sheet separating roller means is rotated to transmit a transportation power to each of the paper sheets while the sheet separating plate means give a braking power to each of the paper sheets so that the paper sheets will be transported separately one from another.

Figure 1:
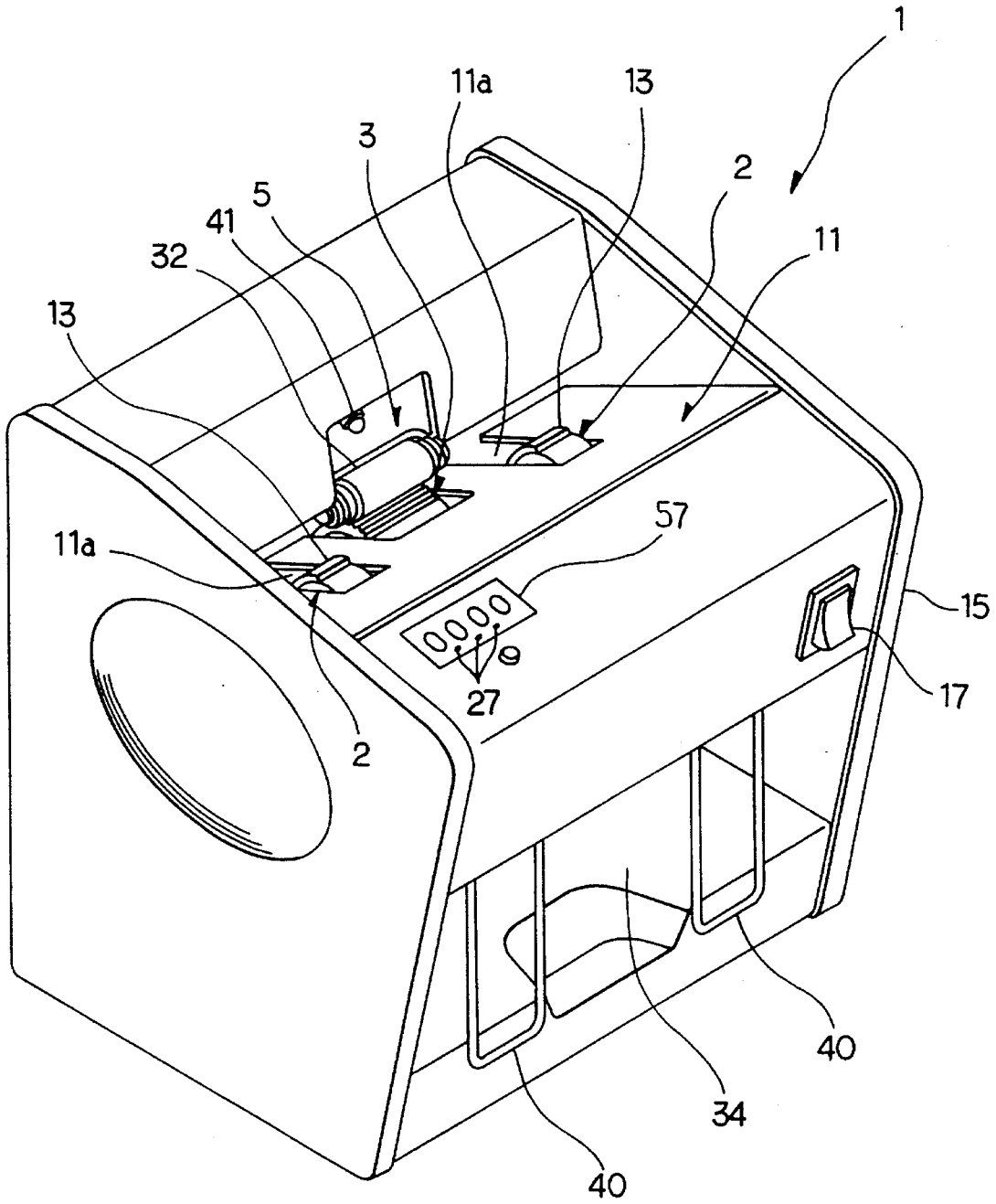
FIG. 1 is a perspective view of a paper sheet counting machine according to the invention.
Figure 2:
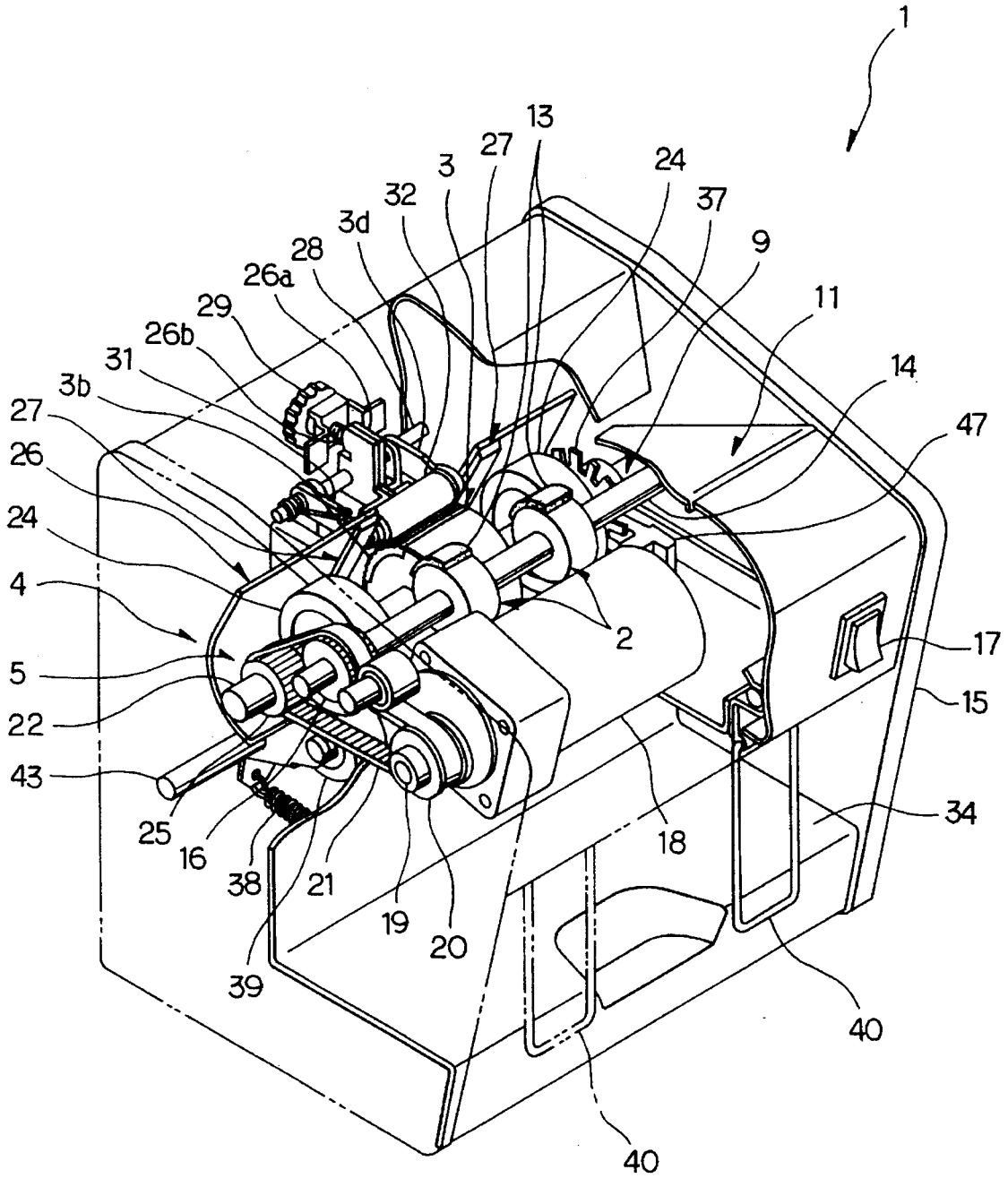
FIG. 2 is a perspective view of the paper sheet counting machine shown partly broken to view the inner mechanism of the machine.
Figure 3:
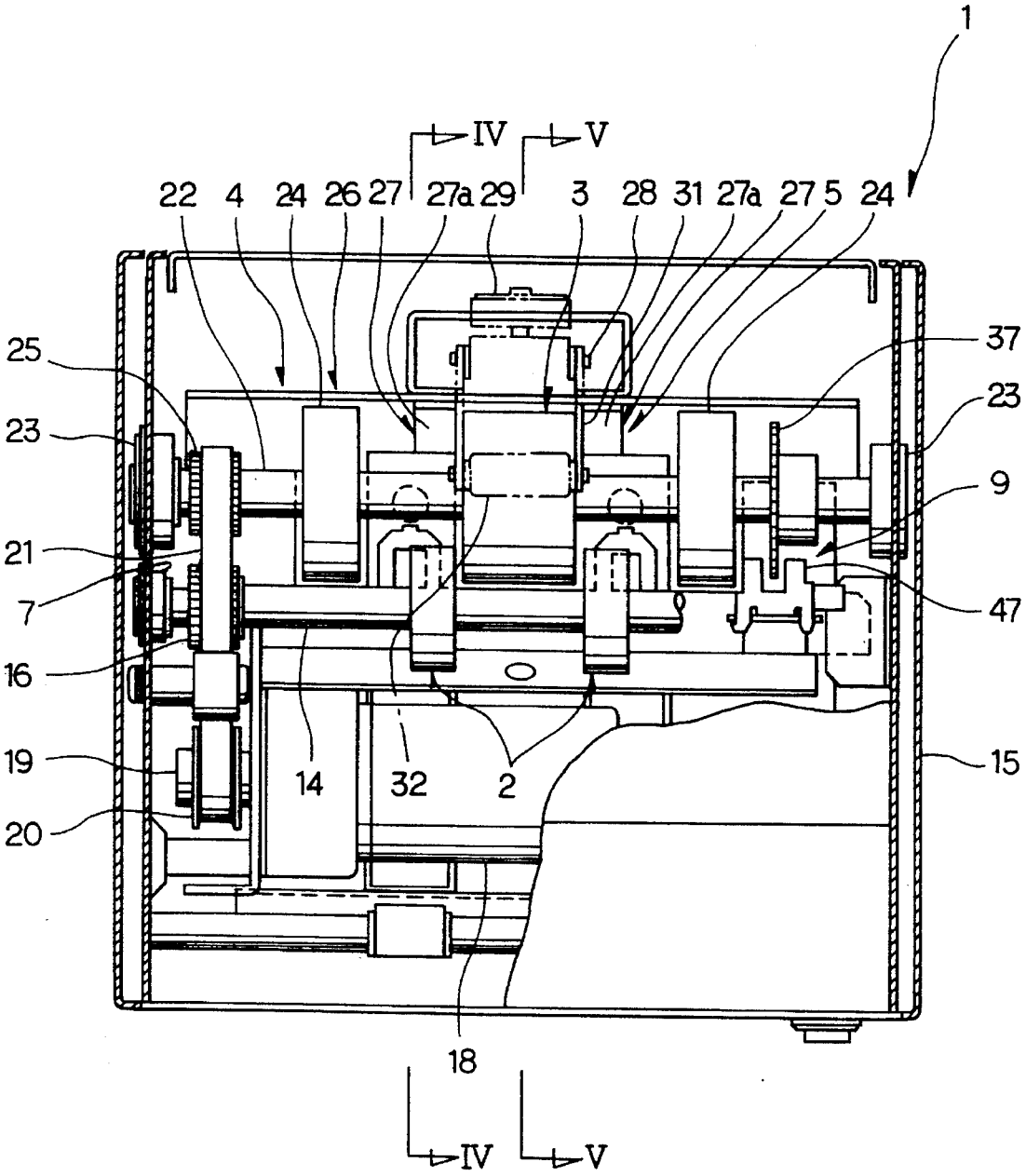
FIG. 3 is a plan view of the paper sheet counting machine shown partly broken to view the inner mechanism of the machine.

DETAILED DESCRIPTION OF THE INVENTION:

The present invention will now be described in reference to the embodiment as shown in the attached drawings. In reference to FIGS. 1 through 4, a paper sheet counting machine 1 of the invention is provided with a pair of catching rollers 2, a sheet separating roller 3, a sheet separating plate 4, a sheet separating device 5, a counter 6, a beater 8 and an angle sensor 9.

The sheet catching rollers 2 are provided to catch and feed out paper sheets 12 one after another from the lowest one of a lot of paper sheets 12 accumulated on a mounting plate 11. The catching rollers 2 have frictional elements 13 attached to the outer circumferences thereof respectively and are fixedly mounted on a shaft 14 which is rotatably journaled on bearings 7 of a frame 15.

The shaft 14 has a gear pulley 16 fixed to one end thereof. The gear pulley 16 is in engagement with a gear belt 21 which is in engagement with a gear pulley 20 fixed to a rotation shaft 19 of a driver such as a gear motor 18, so that the shaft 14 may be rotated in the direction as indicated by arrow mark A (in FIGS. 10 through 13). The gear motor 18 and a power source switch 17 for electric and electronic elements are arranged in the upper and rightward position of the paper sheet counting machine 1.

Figure 4:
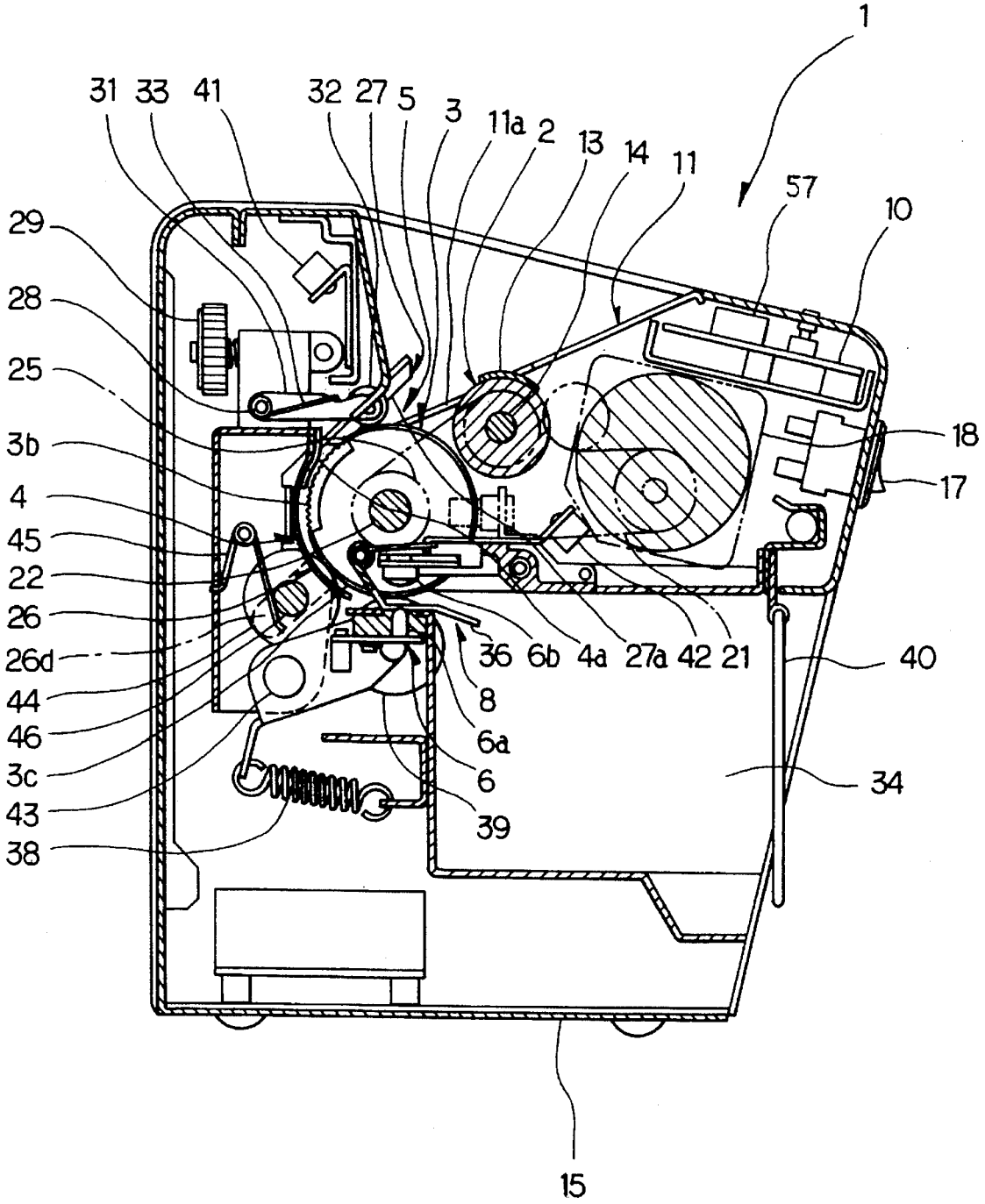
FIG. 4 is a vertically sectioned view of FIG. 3 taken from arrow marks IV—IV.
Figure 5:
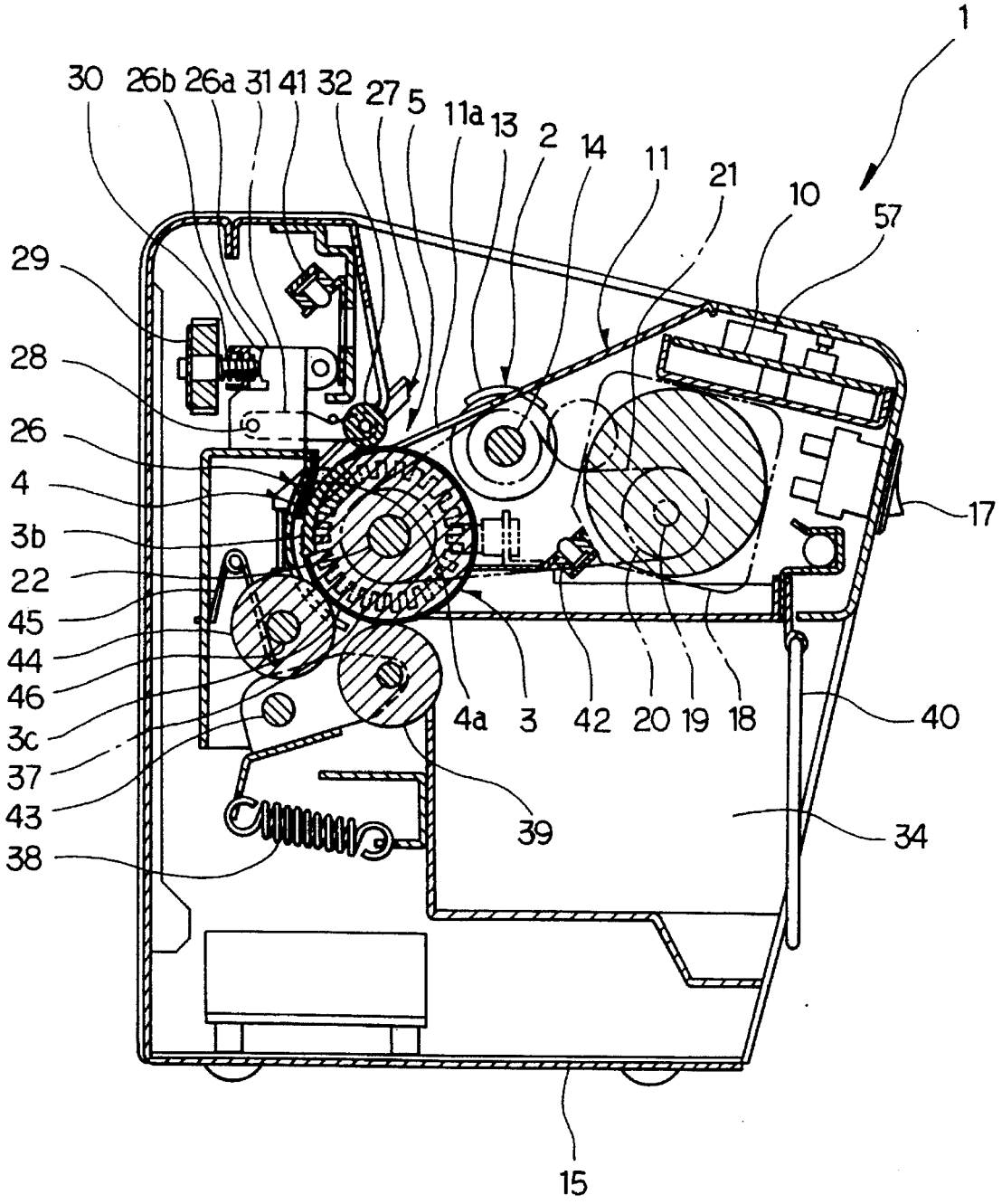
FIG. 5 is a vertically sectioned view of FIG. 3 taken from arrow marks V—V.

As shown in FIGS. 1, 4 and 5, the catching rollers 2 are partly projected up above the mounting plate 11 through a pair of cutouts 11a formed at the mounting plate 11 with a space provided therebetween. The catching rollers 2 are rotated by the gear motor 18 to catch and feed out the paper sheets one after another.

The sheet separating device 5 is composed of a sheet separating roller 3 and a sheet separating plate 4. The sheet separating roller 3 is to separate the paper sheets 12 one from another while transporting the paper sheets which are fed out from the mounting plate 11 by the catching rollers 2. The sheet separating roller 3 is fixed to a shaft 22 which is rotatably journaled on bearings 23 mounted on the frame 15.

Figure 6:
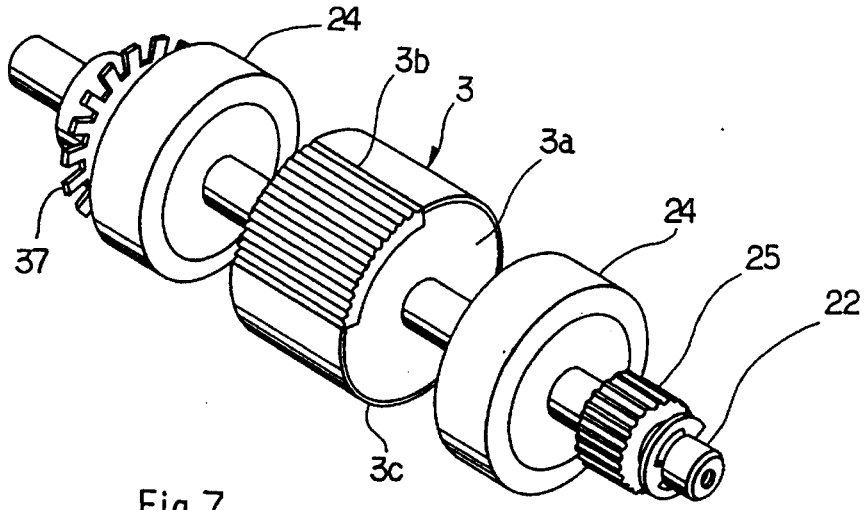
FIG. 6 is a perspective view of a sheet separating roller unit of the machine.

As shown in FIG. 6, the sheet separating roller 3 is fixed to the shaft 22 at the center thereof. The sheet separating roller 3 is substantially composed of a pulley 3*a* of aluminum, a frictional elastic element such as a polyurethane gum 3*b* attached to a part of the circumference of the pulley 3 and a resin sheet 3*c* (resin film) attached to the remaining part of the outer circumference of the aluminum pulley 3*a*. The diameter of the sheet separating roller 3 is partly slightly different. The diameter involving the resin sheet 3*c* is slightly smaller by 0.1 mm by way of example than the diameter involving the polyurethane gum 3*b*.

In case that the thickness of a paper sheet is normally 0.1±0.02 mm and a minimum thickness of a paper sheet (minimum thickness of a tracing paper) is 0.07 mm, it is necessary to provide a difference below 0.1 mm between the diameters at the parts of the polyurethane 3*b* and the resin sheet 3*c* in order to prevent more than 3 paper sheets from entering to the outer circumference other than the part of the polyurethane gum 3*b* of the sheet separating roller 3 and at the same time the part other than the part of the polyurethane 3*b* is prevented from transporting the paper sheets.

The shaft 22 has a pair of gum rollers 24 fixed thereto on both sides of the sheet separating roller 3 and further has a gear pulley 25 fixed to one end thereof. The gear pulley 25 is in engagement with the gear belt 21 which is in engagement with the gear pulley 20 of the gear motor 18, so that the shaft 22 may be rotated in the direction as indicated by arrow mark B as shown in FIGS. 10 through 13.

The sheet separating plate 4 is provided to cooperate with the sheet separating roller 3 so as to separate the paper sheets 12 one after another as the paper sheets are transported. As particularly shown in FIG. 7, the sheet separating plate 4 is an arc shaped guide plate 26 arranged along the outer circumference of the sheet separating roller 3. The arc shaped guide plate 26 has a pressing plate 26*a* fixed thereto at the center thereof by means of a shaft 28. The pressing plate 26*a*. The guide plate 26 is swingably mounted on a shaft 43 which is fixed to the frame 15. The guide plate 26 has a frictional element such as a gum sheet 4*a* of polyurethane attached thereto on the side facing the sheet separating roller 3. The clearance between the surface of the gum sheet 4*a* and the surface of the frictional element 3*b* of the sheet separating roller 3 can be adjusted with a pitch of 0.002 mm in dependence upon the thickness of the paper sheets to be counted.

Next to the sheet separating plate 4, that is the arc shaped guide plate 26, an auxiliary roller 32 is rotatably arranged. In connection with this, the guide plate 26 has a pair of pads 27 of polyurethane attached thereto on both sides of the auxiliary roller 32. The pads 27 have surfaces 27*a* respectively smoothly finished up just like the surface of a mirror. As particularly shown in FIGS. 4 and 5, the surfaces 27*a* of the pads 27 are arranged in an inner region beyond the vertical diameter of the sheet separating roller 3 so as to reduce the probability of more than two paper sheets 12 entering into between the sheet separating roller and the gum sheet 4*a*.

Figure 8:
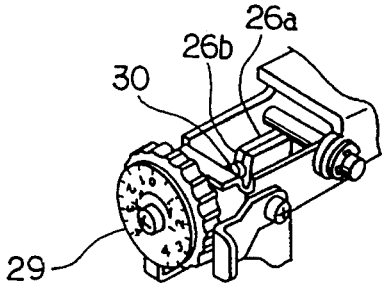
FIG. 8 is a perspective view of a unit for adjusting a clearance of the sheet separating plate.

In reference to FIG. 8, an adjusting screw 30 is provided. The adjusting screw 30 has an adjusting dial 29 fixed to the outer end thereof and has an inner end positioned opposite to a pressing surface 26*b* of the pressing plate 26*a*. The adjusting dial 29 is rotated to move the adjusting screw 30 to and from the surface 26*b* of the pressing plate 26*a* thereby to swing the guide plate 26 around the shaft 43 to and from the sheet separating roller 3. Thus the clearance between the sheet separating rollers and the sheet separating plate 4.

The shaft 28 supporting the pressing plate 26*a* has a pair of support plates 31 swingably mounted thereon in a condition as loaded with coil springs 33 respectively. The support plates 31 normally urge the auxiliary roller 32 which is swingably mounted thereon, thereby to normally press the same against the sheet separating roller 3.

Thus the sheet separating roller 3 and the auxiliary roller 32 are rotated to transport the paper sheets 12 one after another, which are fed out from the mounting plate 11 by the catching roller 2, into the clearance between the sheet separating roller 3 and the sheet separating plate 4 in the direction indicated by the arrow mark B, the clearance having been adjusted in accordance with the thickness of the paper sheets by rotation of the adjusting dial 2. The transportation of the paper sheets 12 is made by the friction between the frictional elements 3*b* of the sheet separating roller 3 and the paper sheet to be transported, and a braking action is produced by the friction between the transported paper sheet and the gum sheet 4*a*. Therefore if more than two paper sheets 12 are fed out by the catching rollers 2, the sheet separating roller 3 and the gum sheet 4*a* of the sheet separating plate 4 will cooperate to separate the sheets one from another.

Figure 7:
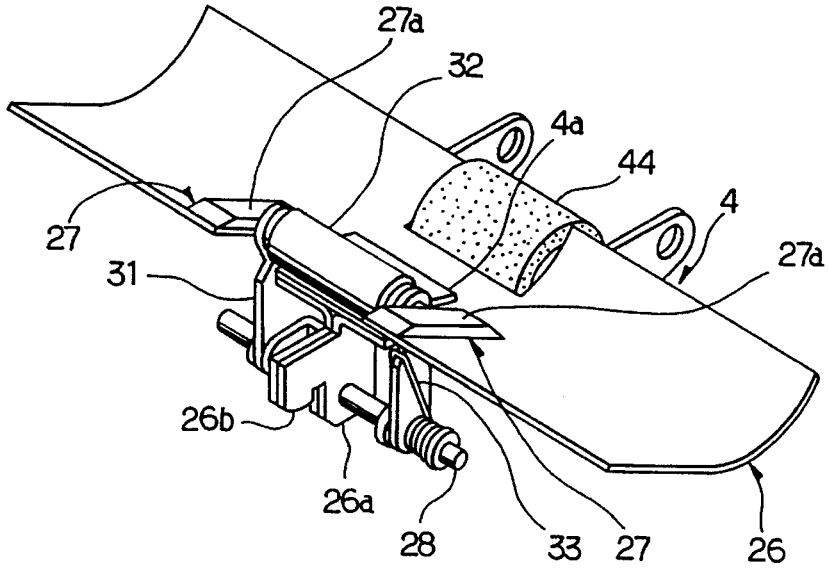
FIG. 7 is a perspective view of a sheet separating plate of the machine.

As shown in FIGS. 4, 5 and 7, next to the sheet separating roller 3, an idle roller 44 of sponge is rotatably mounted on a support shaft 46. The idle roller 44 is biased by a torsion spring 45 and is pressed against the sheet separating roller 3. The shaft 46 supporting the idle roller 44 is movable along an elongated guide hole 26*d* formed on the pressing plate 26*a*. Thus the idle roller 44 is designed to cooperate with the sheet separating roller 3 to transport the separated paper sheet.

The counter 6 is provided to count the number of the paper sheets 12 as these are transported. The counter 6 is composed of a light emitting element 6*a* and a light receiving element 6*b*. As shown in FIG. 4, the light emitting element 6*a* is positioned on the lower side of the paper sheet transporting path and the light receiving element 6*b* is positioned on the upper side of the paper sheet transporting path. Namely a light emitted from the light emitting element 6*a* in the direction as indicated by arrow mark C (in FIG. 12) is interrupted by a paper sheet each time a paper sheet passes the paper sheet transporting path. The light receiving element 6*b* detects the presence and the absence of the light. Thus the counted numbers are indicated in a display 57. The display has error indicating lamps 27 provided therewith for indicating errors by repetition of turning on and off when more than two paper sheets are transported at the same time in a overlapped condition.

Figure 9:
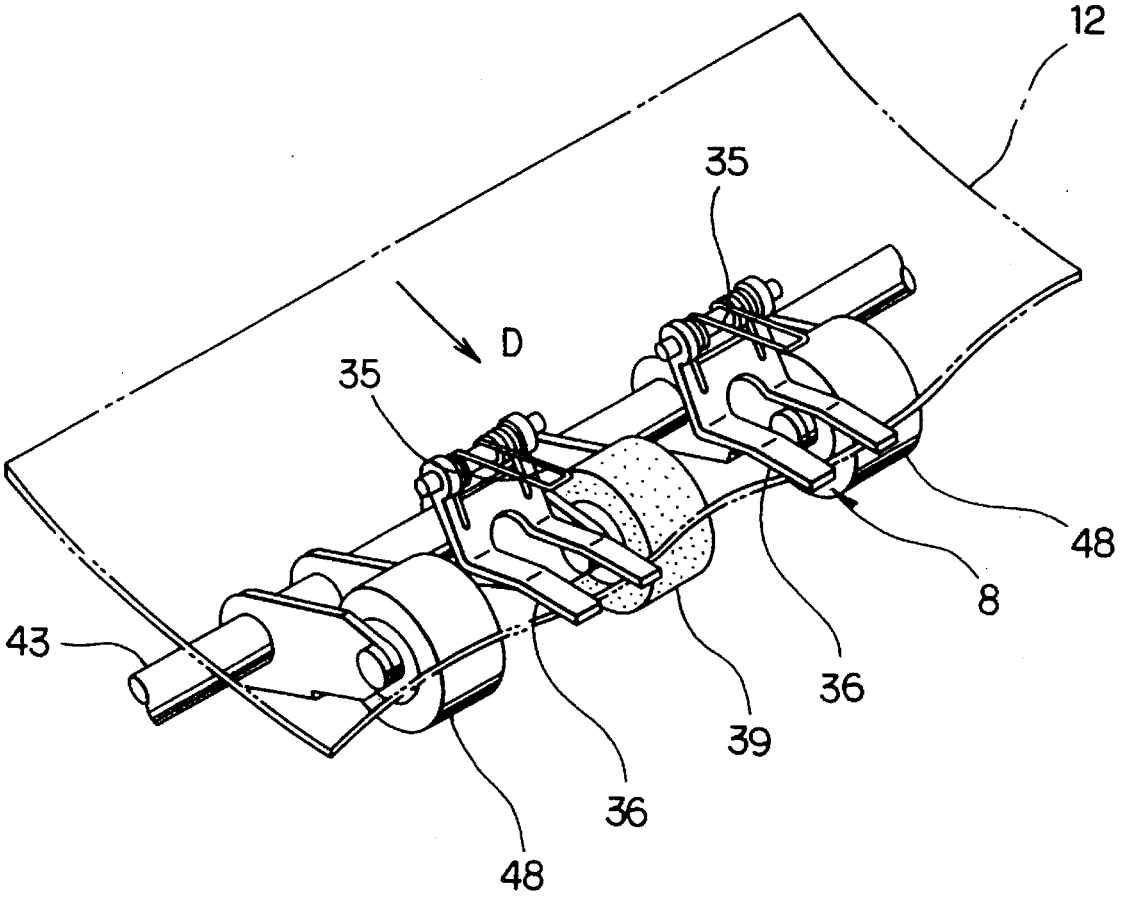
FIG. 9 is a perspective view showing a paper sheet to be transported past a beater while the sheet is bended in a form of wave to increase the stiffness of the sheet.
Figure 10:
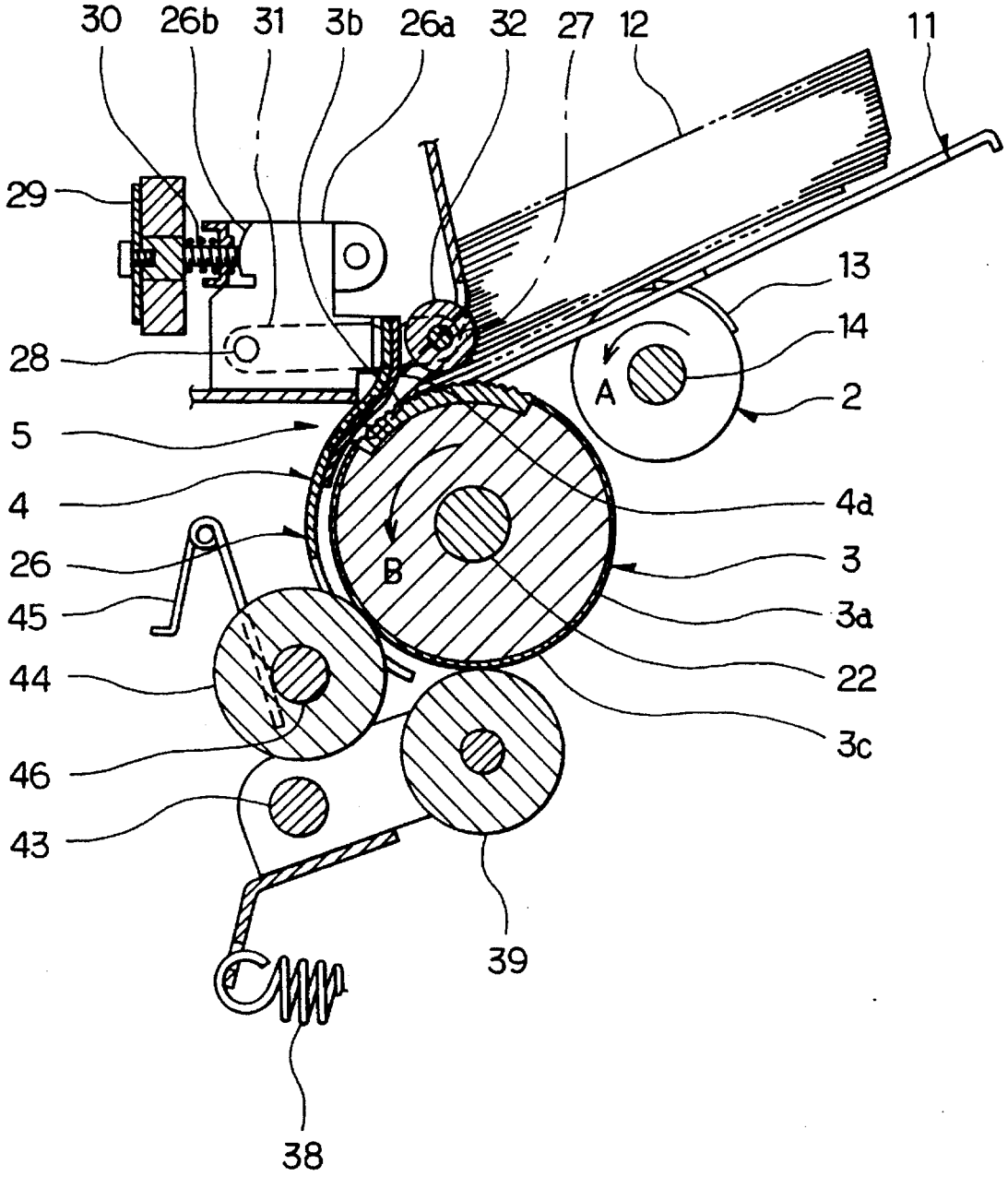
FIG. 10 is a vertically sectioned view showing an essential part of the machine in which catching rollers catche the paper sheets on a mounting plate one after another for transportation thereof.
Figure 11:
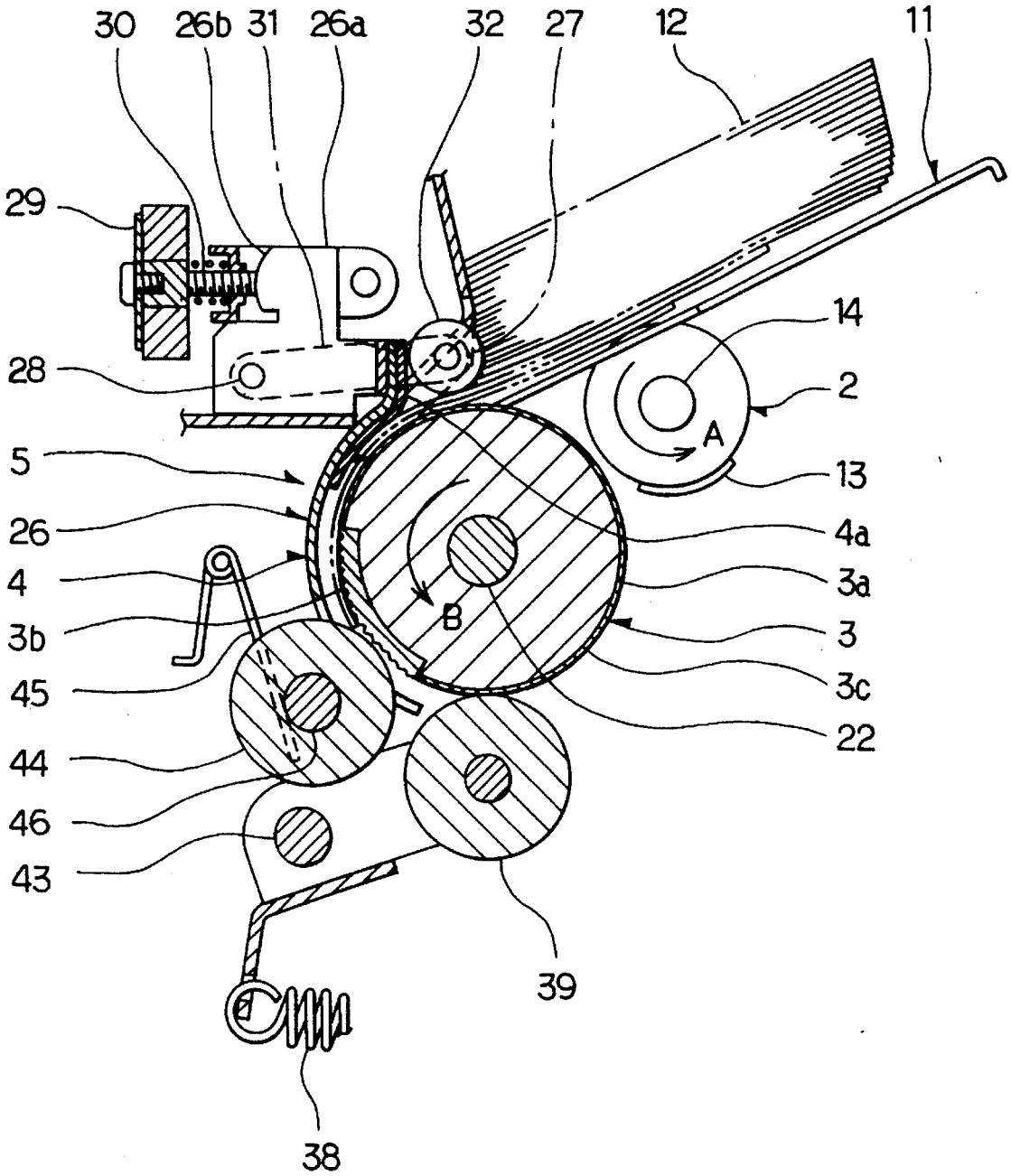
FIG. 11 is a vertically sectioned view showing an essential part of the machine in which two paper sheets are separated one from the other by the sheet separating roller and the sheet separating plate.

The beater 8 is provided to beat the upper side of each paper sheet as it is transported thereby to push the paper sheets 12 one after another down to a stacker 34 where the paper sheets 12 are accumulated. As shown in FIGS. 4 and 9, the stacker 34 is positioned at the end of the paper sheet transporting path. Further a pair of arms 36 are swingably mounted on the frame 15 and are normally biased in the lower direction by springs 35 respectively. Between the swingably arms 36 a guide roller 39 of sponge is arranged. The guide roller 39 is normally biased by a spring 38 and is pressed against the sheet separating roller 3. On both sides of the guide roller 39 a pair of guide rollers 48 of gum arc arranged. The sheet separating roller 3 and the guide rollers 39, 48 cooperate to transport the paper sheets 12 in the horizontal direction.

Figure 12:
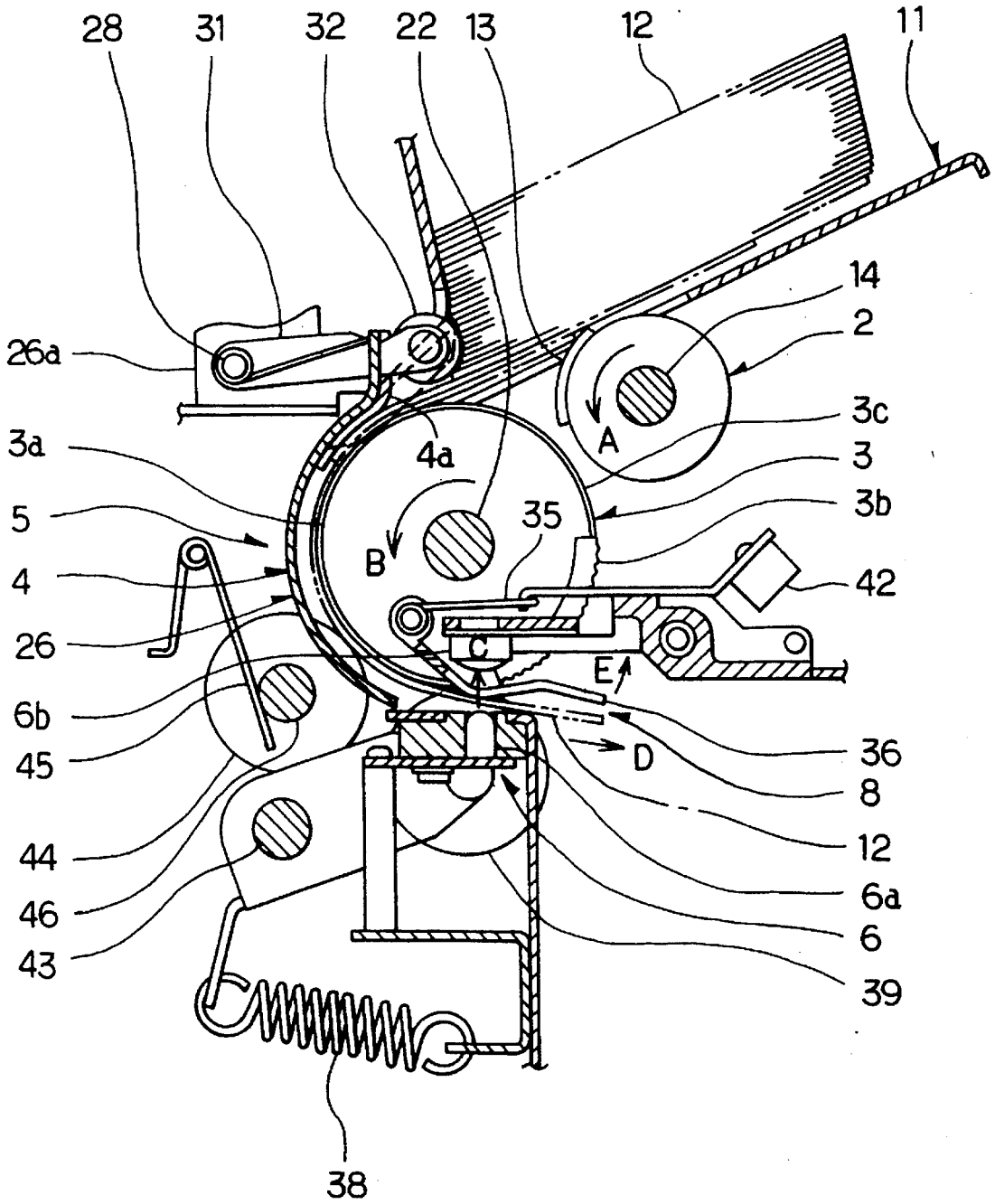
FIG. 12 is a vertically sectioned view showing an essential part of the machine in which a separated paper sheet is transported past the beater while the sheet is count up.

The swingable arms 36 are swingably operated to slightly push down the paper sheet 12 as it is transported and bend the paper sheet into a form of wave vertically of the paper sheet transporting path as shown in FIG. 9, thereby to give a stiffness to the paper sheet 12 as shown in FIG. 12. Thus the paper sheet 12 will displace the swingably arms 36 in the upper direction as indicated by arrow mark E against the action of springs 35 by means of the given stiffness of the paper sheet itself. The swingable arms displaced in the upper direction will come down when the paper sheet 12 is released from the clamp of the sheet separating roller 3 and the guide rollers 36 and beat the upper side of the paper sheet 12 to push down the paper sheet.

The angle sensor 9 is provided to detect if the paper sheets 12 are transported in a normal or abnormal condition and produces a warning signal when a paper sheet is transported in the abnormal condition. In reference to FIGS. 2, 3, 5 and 6, the angle sensor 9 is composed of a light interrupting disc 37 which is fixed to the roller shaft 22 for rotation therewith and a photocoupler 47 embracing a part of the light interrupting disc 37. The light interrupting disc 37 has a predetermined number of radial slits provided thereon for dividing one complete rotation angles of the sheet separating roller 3. The disc 37 is rotated together with the sheet separating roller 3 to interrupt the light emitted from the photocoupler 47 and produces a number of pulse signals in proportion to the rotation angles of the sheet separating roller 3.

The counter 6 detects the interruptions of light from the light emitting element 6*a* by the paper sheets 12 to count the number of the paper sheets to be transported while the counter 6 counts the number of the pulse signals produced by the angle sensor 9, the number of the pulse signals being predetermined by the width of the paper sheets 12 to be transported. If the counted value is different from the number of pulses predetermined by the width of the paper sheet, namely if the counted value is more than the predetermined pulse number, it is determined that more than two paper sheets have been transported at the same time. On the other hand, if the counted value is less than the predetermined pulse number, then it is determined that the paper sheet partly cut away or another type of paper sheet has been transported. In this case a warning signal is produced and the error indicating lamps 27 is repeatedly turned on and off.

In reference to FIGS. 1, 2, 4 and 5, a pair of swingable stoppers 40 are provided on the front side of the stacker 34 so as to prevent the paper sheets 12 from running out of the stacker as the paper sheets 12 are transported one after another in the horizontal direction into the stacker 34 and to direct the paper sheets 12 to be correctly accumulated in the stacker 34.

Further a light emitting element 41 is provided above the sheet mounting plate 11 and a light receiving element 42 is provided below the sheet mounting plate 11 as shown in FIG. 5 for detecting if the paper sheets 12 are positioned on the sheet mounting plate 11.

The invention is constructed as mentioned above and the operation will be described. In reference to FIG. 10, the preparation for counting the paper sheets is initiated by manual rotation of the adjusting dial 29 to press the adjusting screw 30 against the pressing surface 26*b* of the pressing plate 26*a* thereby to swing the arc shaped guide plate 26 around the shaft 43 and to adjust the clearance between the sheet separating roller 3 and the sheet separating plate 4 in accordance with the paper sheets to be counted.

Since the optimum clearance between the sheet separating roller 3 and the gum sheet 4*a* of the sheet separating plate 4 is determined by the thickness of the paper sheets to be counted, it is preferable to set the clearance to be slightly narrower than the thickness of the paper sheets 12.

When the power source switch 17 is turned on and a set of accumulated paper sheets 12 is placed on the sheet mounting plate 11, the light emitted from the light emitting element 41 is interrupted by the paper sheets 12 and the light receiving element 42 ceases to receive the light. Thus it is detected that the paper sheets 12 are present on the sheet mounting plate 11. Then the gear motor 18 is rotated.

The rotation of the gear motor 18 is transmitted to the catching rollers 2 through the rotation shaft 19, gear pulley 20 and the gear belt 21. The catching rollers 2 are then rotated in the direction as indicated by the arrow mark A and the sheet separating roller 3 is rotated through the gear pulley 25 and the support shaft 22 in the direction as indicated by the arrow mark B.

When the catching rollers 2 are rotated and the frictional element 13 comes to contact the lowest paper sheet 12, the paper sheets 12 are fed out to the sheet separating roller 3 one after another due to the friction produced between the frictional element 13 and the paper sheets 12.

Since the friction coefficient between the catching rollers 2 and the paper sheets 12 is set to be larger than that existing between the paper sheets 12, and further since the second paper sheet from the lowest is in contact with the auxiliary roller 32, only the lowest paper sheet 12 is pulled out.

The pulled out paper sheet 12 is clamped and transported by the sheet separating roller 3 rotated in the direction as indicated by the arrow mark B and the auxiliary roller 32. Thus the paper sheets 12 are transported one after another while these are counted and the counted paper sheets 12 are accumulated in the stacker 34. In the meantime, if more than two paper sheets are fed out at the same time in the overlapped condition, the two paper sheets 12 are transported into the clearance between the sheet separating roller 3 and the sheet separating plate 4. However the lower paper sheet comes in contact with the sheet separating roller 3 and the upper paper sheet comes in contact with the gum sheet 4*a* of the sheet separating plate 4.

Since the friction coefficients between the polyurethane gum 3*b* and the paper sheet 12 and between the gum sheet 4*a* of the sheet separating plate 4 are set to be of a value larger than the value between the paper sheets 12 themselves, a transportation power is applied to the lower paper sheet 12 by the friction of the polyurethane gum 3*b* while a braking power is applied to the upper paper sheet 12 by the friction of the gum sheet 4*a*.

Since the applied transportation power and braking power are larger than the friction between the paper sheets 12 themselves, the upper paper sheet 12 is stopped at the enterance of the sheet separating device 5 while the lower paper sheet 12 is transported.

In reference to FIG. 12, the separated paper sheet 2 is wound around the sheet separating roller 3 and is further clamped by the sheet separating roller 3 and the idle roller 44 and is turned by 180 degrees. Thus the paper sheet 12 is transported in the horizontal direction as indicated by the arrow mark D to the beater 8. When the front part of the paper sheet 12 comes to the counter 6, the paper sheet 12 interrupts the light emitted from the light emitting element 6a in the direction as indicated by arrow mark C, the light receiving element 6b detects the absence of the light and increases the displayed count number by 1. Thus the counter 6 counts up the paper sheets 12 one by one each time the paper sheet 12 is transported past the counter 6.

Simultaneously when the light receiving element 6a detects the front end of the paper sheet 12, the angle sensor 9 is operated to produce intermittent pulse signals until the paper sheet 12 is transported past the counter 6 as the radially slitted disc 37 intermittently interrupts the light of the photocoupler 47.

When the rear end of the paper sheet 12 is transported past the counter 6, the light from the light emitting element 6a is permitted to reach the light receiving element. Namely when the paper sheet 12 is detected to have been transported past the counter 6, the operation of the angle sensor 9 is stopped as the counter 6 has counted up the pulse signals produced by the angle sensor 9.

The total number of the pulse signals counted up is proportional to the rotation angles of the sheet separating roller 3, that is, proportional to the width of the paper sheet 12. Therefore if the total number of the pulse signals is different from the number determined by the width of the paper sheet 12, it is determined that the machine has committed an error in transportation of the paper sheet 12. Then a warning signal is produced and the error indicating lamps 27 are blinked and simultaneously the machine 1 is stopped.

One example of the operation error committed by the machine 1 is that the machine 1 will transport more than two paper sheets 12 at the same time in the overlapped condition. In this case, the total number of the counted pulse signals is more than the predetermined number of pulse signals. Another example of error is that a paper sheet 12 is partly cut away or another type of smaller sheet paper is transported. In this case, the total number of pulse signals is less than the predetermined number of pulse signals.

When the paper sheet 12 is transported in the direction as indicated by the arrow mark D to the beater 8 while the paper sheet 12 is clamped by the sheet separating roller 3 and the guide roller 39, 48, the pair of arms 36 positioned between the guide roller 39 and the sheet separating roller 3 and between the guide roller 48 and the sheet separating roller 3 respectively are operated to swing down to slightly press down the paper sheet 12 and thus bend the same into a form of wave vertically of the paper sheet transporting path. Thus the paper sheet 12 is given a stiffness as shown in FIG. 9.

Figure 13:
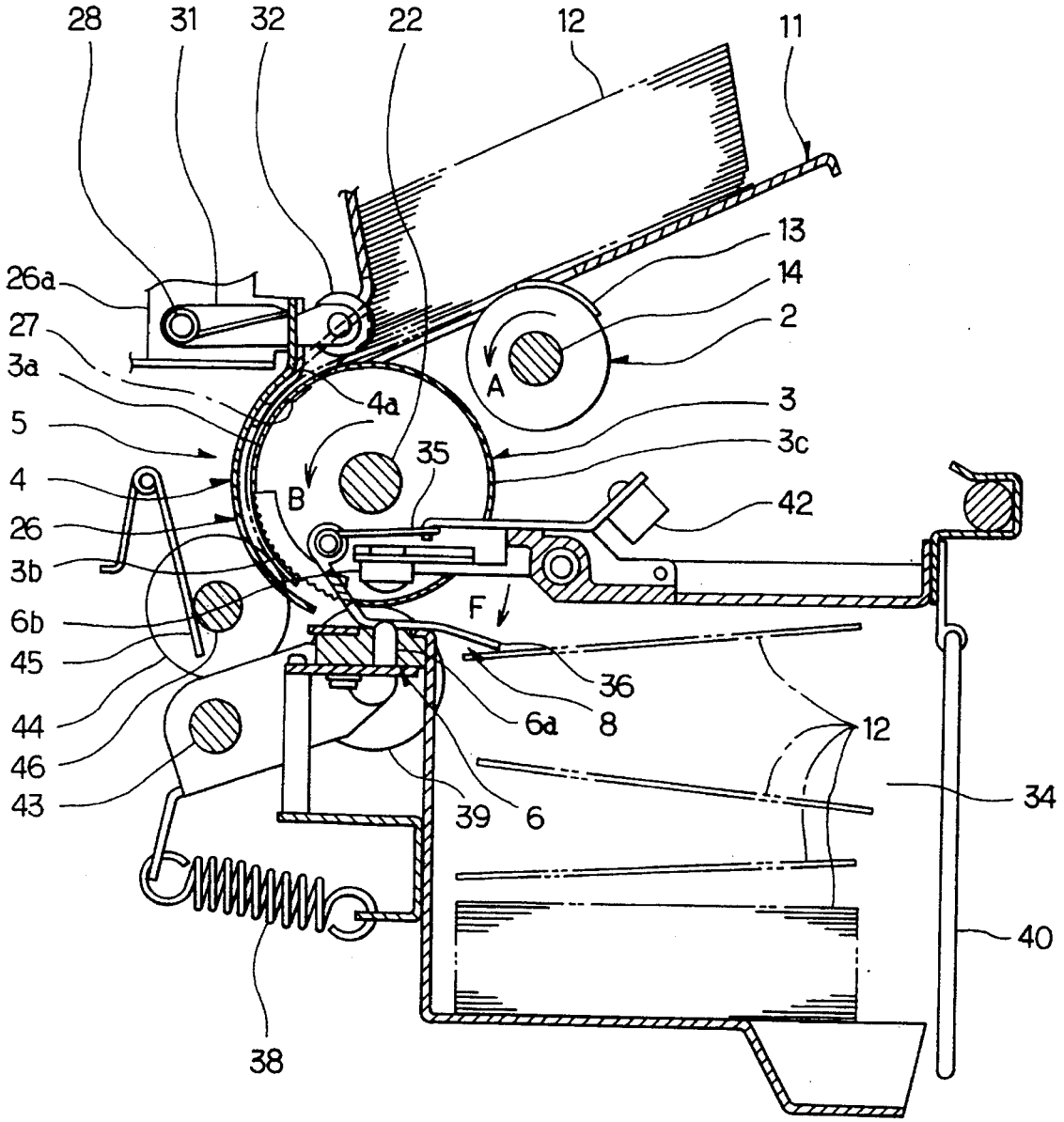
FIG. 13 is a vertically sectioned view showing an essential part of the machine in which the paper sheet transported past the beater is pushed down by the beater and is accumulated on a stacker.

The paper sheet 12 having the stiffness will turn up the swingably arms 36 against the actions of the springs 35 in the direction as indicated by the arrow mark E as shown in FIG. 12. When the paper sheet 12 is released from the sheet separating roller 3 and the guide rollers 39, 48 as it is further transported, the swingable arms 36 are operated swing down due to the actions of the springs 35 in the direction as indicated by the arrow mark F as shown in FIG. 13. Thus the swingable arms 36 beat the upper side of the paper sheet 12 to give the same an initial velocity and simultaneously press down the paper sheet 12.

The downwardly pressed paper sheet 12 is further transported obliquely aslant while the rear part of the paper sheet 12 is in contact with the guide rollers 36. Thus the paper sheet 12 is separated from the sheet separating roller 3 and the guide rollers 36 and is transported to the stacker 34 to be accumulated therein.

The paper sheets 12 to be counted up are transported one after another from the Sheet separating roller 3 to the stacker 34 in the horizontal direction at an interval of 15–20 msec. The paper sheets 12 are however given an initial velocity by the beater 8 which presses down each of the paper sheets 12. This will prevent the phenomenon which may otherwise be occurred while a paper sheet is floating in the air as the same is released from the sheet separating roller 3, another paper sheet is transported out to cause an interference with the preceded paper sheet. Thus the counted paper sheets 12 are securely accumulated in the stacker 11.

The above mentioned operation is repeatedly performed until the paper sheets 12 positioned on the sheet mounting plate 11 are all transported up. When it comes that none of the paper sheets 12 remain on the sheet mounting plate 11, the light from the light emitting element 41 is received by the light receiving element 42 and the rotation of the gear motor 18 is stopped. Then the power source switch 17 is turned off and the paper sheet counting operation is finished.

What is claimed is:

1. A machine for counting paper sheets comprising drive means; sheet separating roller means rotated by the drive means to wind the paper sheets therearound to transport the same one after another, said sheet separating roller means having a frictional elastic element attached partly to the outer circumference thereof and said frictional elastic element having a friction coefficient in connection with the paper sheets which is larger than a friction coefficient existing between the paper sheets themselves; and sheet separating plate means provided opposite to the sheet separating roller means with a predetermined clearance provided therebetween, said sheet separating plate means having a frictional element attached thereto at a position facing the sheet separating roller means and said frictional element having a friction coefficient in connection with the paper sheets which is larger than the friction coefficient existing between the paper sheets themselves, whereby said sheet separating roller means is rotated to transmit a transportation power to each of the paper sheets while said sheet separating plate means gives a braking power to each of the paper sheets so that the paper sheets may be transported separately one from another.

2. A machine for counting paper sheets comprising sheet mount means including a plate for mounting thereon the paper sheets accumulated one on another; catching roller means including a plurality of rollers rotated to catch the paper sheets one after another to sequentially feed out the paper sheets from said mount plate; sheet separating means including a sheet separating roller rotated to wind the paper sheets therearound to transport the same one after another as the paper sheets are sequentially fed out by the catching rollers to the sheet separating roller, said sheet separating roller having a frictional elastic element attached partly to the outer circumference thereof and said frictional elastic element having a friction coefficient in connection with the paper sheets which is larger than a friction coefficient between the paper sheets; and another sheet separating means including a sheet separating plate provided opposite to said sheet separating roller with a predetermined clearance provided therebetween, said sheet separating plate having a frictional element attached thereto at a position facing said sheet separating roller and said frictional element having a friction coefficient in connection with the paper sheets which is larger than a friction coefficient existing between the paper sheets themselves, whereby said sheet separating roller is rotated to transmit a transportation power to each of the paper sheets while said sheet separating plate gives a braking power to each of the paper sheets so that the paper sheets may be transported separately one from another.

3. A machine for counting paper sheets comprising sheet mounting means including a plate for mounting thereon the paper sheets as accumulated one on another; catching roller means including a plurality of rollers rotated to catch the paper sheets one after another to feed out the same from the sheet mounting plate; sheet separating means including a sheet separating roller rotated to wind the paper sheets therearound one after another and transport the same as the paper sheets are fed out from the sheet mounting plate, said roller having a frictional elastic element attached partly to the outer circumference thereof, said frictional elastic element having a friction coefficient in connection with the paper sheets which is larger than a friction coefficient between the paper sheets themselves; another sheet separating means including a plate arranged opposite to said sheet separating roller with a clearance provided therebetween, said sheet separating plate having a frictional element attached thereto facing said sheet separating roller, said frictional element having a friction coefficient in connection with the paper sheets which is larger than a friction coefficient between the paper sheets themselves; counter means operated to count up the paper sheets each time when one of the paper sheets is transported past the counter means; whereby said sheet separating roller is rotated to transmit a transportation power to each of the paper sheets while said paper separating plate gives a braking power to each of the paper sheets so that the paper sheets may be transported separately while the paper sheets are counted up by said counter means.

4. A machine for counting paper sheets comprising sheet mounting means including a plate for mounting thereon the paper sheets as accumulated one on another; sheet catching means including a plurality of rollers rotated to catch the paper sheets one after another and feed out the same sequentially from the sheet mounting plate; sheet separating means including a sheet separating roller rotated to wind therearound the paper sheets to transport the same one after another as the paper sheets are fed out sequentially from the sheet mounting plate by said sheet catching rollers, said sheet separating roller having a frictional elastic element attached partly to the outer circumference thereof, said frictional elastic element having a friction coefficient in connection with the paper sheets which is larger than a friction coefficient existing between the paper sheets themselves; another sheet separating means including a sheet separating plate arranged opposite to said sheet separating roller with a predetermined clearance provided therebetween, said sheet separating plate having a frictional element attached thereto facing said sheet separating roller, said frictional element having a friction coefficient in connection with the paper sheets which is larger than a friction coefficient existing between the paper sheets themselves; counter means positioned in a course through which the paper sheets are transported and operated to count up the paper sheets one by one each time one of the paper sheets are transported past the counter means; beater means including a plurality of arms positioned adjacent to said sheet separating roller, said arms being vertically swingable and normally biased in the downward direction to render each of the paper sheets into a form of wave as the paper sheet is transported out of the sheet separating roller to give a stiffness to each of the paper sheets, said arms being displaced up against the biasing action by each of the paper sheets having the stiffness and being biased down to beat the upper side of the paper sheet when it is completely transported out of the sheet separating roller; whereby said sheet separating roller is rotated to transmit a transportation power to each of the paper sheets while said sheet separating plate gives a braking power to each of the paper sheets thereby to transport the paper sheets in a condition as being separated one from another while the paper sheets are counted up and beaten down into a stacker to be accumulated therein.

5. A machine for counting paper sheets comprising sheet mounting means including a plate for mounting thereon the paper sheets as accumulated one on another; sheet catching means including a plurality of rollers rotated to catch the paper sheets one after another and feed out the same sequentially from the sheet mounting plate; sheet separating means including a sheet separating roller rotated to wind therearound the paper sheets to transport the same one after another as the paper sheets are fed out sequentially from the sheet mounting plate by the sheet catching rollers, said sheet separating roller having a frictional elastic element attached to the outer circumference thereof, said frictional elastic element having a friction coefficient in connection with the paper sheets which is larger than a friction coefficient existing between the paper sheets themselves; another sheet separating means including a paper separating plate arranged opposite to said sheet separating roller with a predetermined clearance provided therebetween, said sheet separating plate having a frictional element attached thereto facing said sheet separating roller, said frictional element having a friction coefficient in connection with the paper sheets which is larger than a friction coefficient existing between the paper sheets themselves; counter means positioned in a course through which the paper sheets are transported and operated to count up the paper sheets one by one by continuing to produce a detecting signal until each of the paper sheets is transported past the counter means; angle sensor means operated to produce a pulse signal each time the sheet separating roller is rotated by a predetermined rotation angle until each of the paper sheets is transported past the counter; and warning means operated to produce a warning signal when the number of the pulse signals produced by the angle sensor is out of accord with a predetermined width of the paper sheets.

6. The machine as defined in one of the claims 1 through 5 further comprising a first guide rollers arranged to cooperate with the sheet separating roller to transport the paper sheets and a plurality of second guide rollers arranged coaxially with the first guide roller, said first and second guide rollers cooperating with said beater means to render each of the paper sheets into the form of wave to give the same the stiffness.

7. The machine as defined in one of the claims 1 through 5 further comprising adjusting means manually operated to adjust the clearance between said sheet separating roller and said sheet separating plate.

8. The machine as defined in one of the claims 1 through 5 wherein said sheet separating roller further has a resin sheet or a resin film attached to the outer circumference thereof except the part to which the frictional elastic element is attached such that the diameter of the sheet separating roller involving said resin sheet or said resin film is slightly smaller than the diameter thereof involving said frictional elastic element.

9. The machine as defined in one of the claims 1 through 5, wherein said sheet mounting plate, said sheet catching rollers, said sheet separating roller and said sheet separating plate are arranged in a manner that the paper sheets wound around the sheet separating roller are transported while turned by 180 degress in a horizontal direction into the stacker where the paper sheets are sequentially accumulated.

* * * * *